United States Patent [19]

Gould et al.

[11] Patent Number: 4,595,111

[45] Date of Patent: Jun. 17, 1986

[54] DEVICE FOR REMOVING A FLEXIBLE CAP FROM A CYLINDRICAL NECK

[75] Inventors: Jerome Gould, Encino; Thomas W. Kellogg, Irvine, both of Calif.

[73] Assignee: Dulux Australia Ltd., Victoria, Australia

[21] Appl. No.: 451,593

[22] Filed: Dec. 20, 1982

[30] Foreign Application Priority Data

Dec. 18, 1981 [AU] Australia ..... PF2018

[51] Int. Cl.[4] ..... B65D 41/18

[52] U.S. Cl. ..... 215/303; 215/305; 220/285

[58] Field of Search ..... 215/295, 303, 305, 225, 215/296, 355, 359; 220/285, 260, 352, 286, 282, 306

[56] References Cited

U.S. PATENT DOCUMENTS

| | | | |
|---|---|---|---|
| 856,280 | 6/1907 | Morse | 220/306 X |
| 1,041,694 | 10/1912 | Stupian | 220/285 |
| 1,675,647 | 7/1928 | Genjack | 220/286 |
| 2,334,225 | 11/1943 | Socke | 220/285 |
| 2,699,270 | 1/1955 | Nagey et al. | 220/286 |
| 3,181,719 | 5/1965 | Schaich | 215/295 |
| 3,430,798 | 3/1969 | Goyet et al. | 215/320 X |
| 3,759,411 | 9/1973 | Horvath | 215/209 |
| 3,910,444 | 10/1975 | Foster | 215/295 |
| 3,945,525 | 3/1976 | Jones | 215/295 X |
| 4,171,057 | 10/1979 | Gach | 215/295 X |

FOREIGN PATENT DOCUMENTS

| | | | |
|---|---|---|---|
| 85029 | 2/1958 | Denmark | 220/285 |
| 391120 | 10/1908 | France | 220/285 |

*Primary Examiner*—Allan N. Shoap
*Assistant Examiner*—Bryon Gehman
*Attorney, Agent, or Firm*—Cushman, Darby & Cushman

[57] ABSTRACT

A device for removing a flexible cap from the end of a cylindrical neck over which it is fitted includes an ejector element constrained to move in a circumferential track one side of which track is formed by the lip of the cap. The ejector element is shaped such that movement thereof along the track will force the element against the lip of the cap, displacing it and rendering it readily removable.

The device can usefully be incorporated into containers such as storage jars, bottles and paint containers, or into pipe ends.

1 Claim, 6 Drawing Figures

DEVICE FOR REMOVING A FLEXIBLE CAP FROM A CYLINDRICAL NECK

This invention relates to a means of removing a replaceable flexible cap from the end of a cylindrical neck.

Flexible caps moulded from plastics materials are now commonly used to seal the open ends of a variety of cylindrical containers, for example glass and plastics jars or bottles. The cap is forced over a circumferential flange on the neck of the filled container and because of its flexible, resilient nature and shape, it encompasses the flange in an air-tight seal.

Many such seals are required to be broken only once, when the container is emptied and the container is discarded. This is seen in the food and beverage industry, for example. The seal can be broken easily by, for example, the use of a "rip-off" ring, the removal of which immediately breaks the seal.

We are concerned in this invention with the problem of repeatedly closing and opening a neck, for example to remove incrementally portions of the contents of a container to which it is attached, without losing the benefits of an air-tight seal when required.

By the jucicious selection of the materials used, a combination of neck and cap can be arrived at which, for some purposes, does permit ready manual application and removal of the cap. However, if a sufficiently robust and vapour-tight seal is to be provided for some purposes, for example on a container of paint, adhesive or perfume, it is often difficult to remove the cap without permanently damaging it or the neck of the container.

We have now found a way of overcoming this problem of removing a tightly fitting flexible cap by providing within or on the neck itself an ejector slide which is readily manipulated by hand to break quite tight seals.

Accordingly we now provide a means for removing a replaceable flexible cap from the end of a cylindrical neck over which it is fitted, the means consisting of an ejector element slideably located in a track defined by a circumferential shoulder in the cylindrical neck and the lip of the flexible cap, the ejector element being so-contoured that as it is rotated about the neck and along the track it displaces and releases the flexible cap from the cylindrical neck.

The ejector element may be; for example, a button sliding within a recessed track formed partially by a shoulder moulded into the cylindrical neck and partially by the lip of the flexible cap. If the button is wedge-shaped with respect to the axis of the track and the track itself is suitably dimensioned and of varying width, rotation of the button about the cylindrical neck and along the track will bring increasing pressure to bear on the lip of the flexible cap, until it deforms sufficiently for it to be ejected from the end of the cylindrical neck.

We have found, however, that it is often more satisfactory to make the ejector element in the form of a ring encircling the cylindrical neck. It is then easier to retain the ejector element on the cylindrical neck and in correct alignment when the flexible cap is not present.

The invention will now be further described with reference to one preferred embodiment. FIG. 1 shows the device in perspective view. The ejector element is indicated by the letter A. FIGS. 2, 3 and 4 show the device in side view with the element A in different stages of rotation as will be further described hereinunder.

IN THE DRAWINGS

Figure 1:
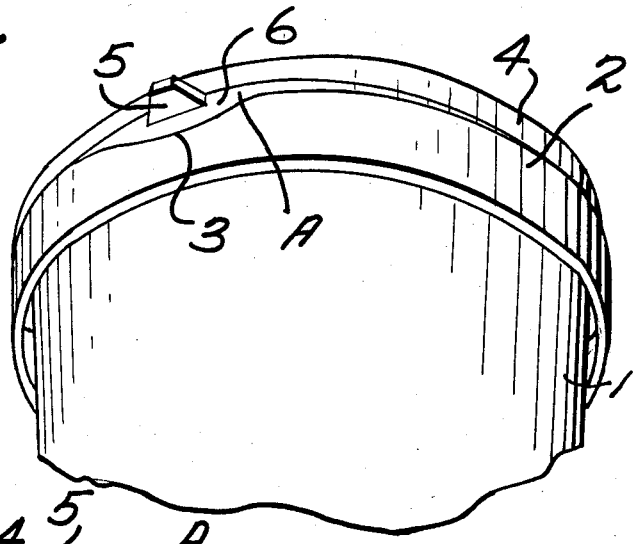
FIG. 1 is a fragmentary perspective view of a cylindrical neck fitted with a replaceable flexible cap according to the invention.
Figure 2:
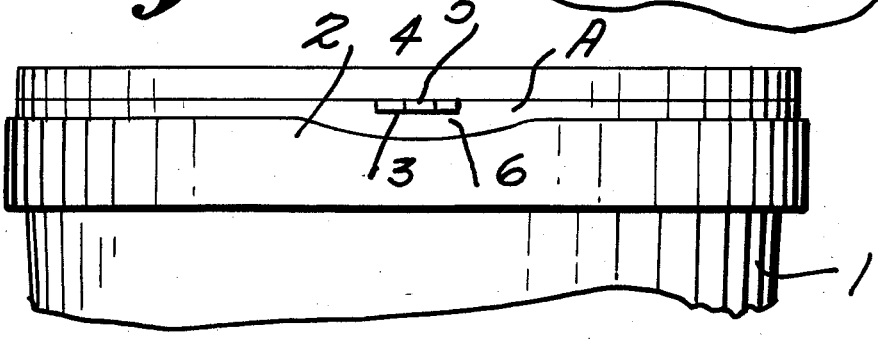
FIGS. 2, 3 and 4 are elevational views of the neck and cap of FIG. 1 illustrating how the cap is removed.

Referring first to FIG. 1, a cylindrical neck 1 bears a flange 2 of generally uniform width save for a section 3 where a length of flange wall facing the open end of the neck 1 is contoured to provide a concave depression in the line of the wall. The flange 2 is set back a sufficient distance from the open end of the neck 1 to enable the neck to receive a flexible cap 4 and still leave a gap encircling the neck 1, between the cap 4 and flange 2. The cap 4 is held in a tight engagement with the open end of the neck 1 by a conventional arrangement of external flange 1*a* on the neck 1 and co-operating circular internal groove 4*a* in the cap 4.

A rotatable ejector element A in the form of a ring encircling the cylindrical neck 1 bears a lug 5 and a lobe 6. The lobe 6 is so-shaped that when it is positioned opposite the concave wall section 3 of the flange 2, the rotatable ejector element A closes the gap between the cap 4 and the flange 2.

Figure 3:
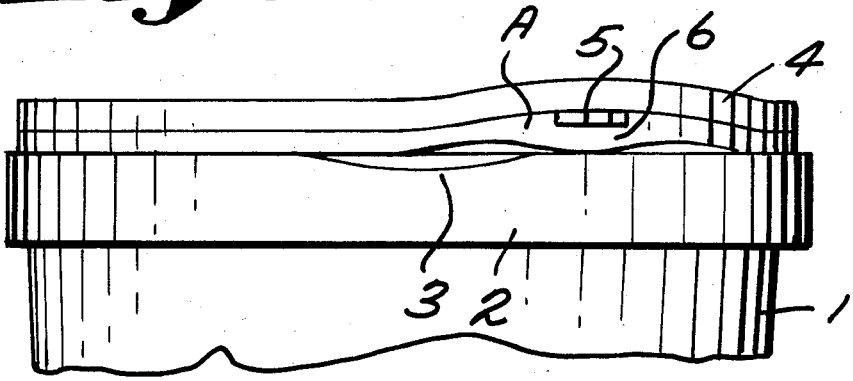

FIG. 3 shows that as the rotatable ejector element A is rotated about the neck 1, the lobe 6 rides up from the contoured section 3 of the flange 2, thus exerting an axial force away from the flange 2 and displaces the cap 4 from engagement with the neck 1.

Figure 4:
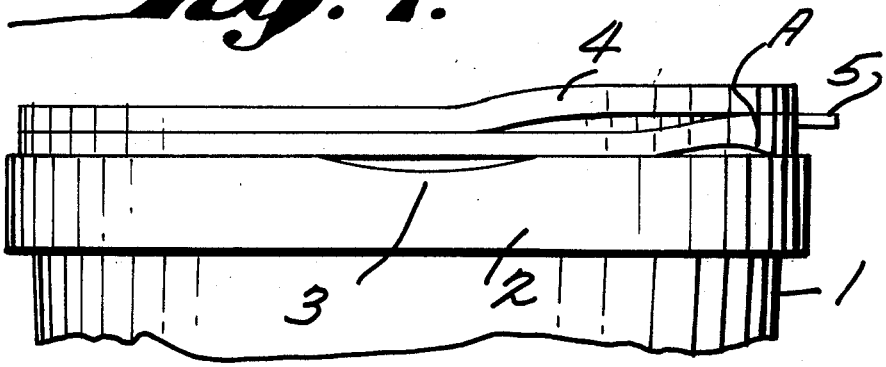
Figure 5:
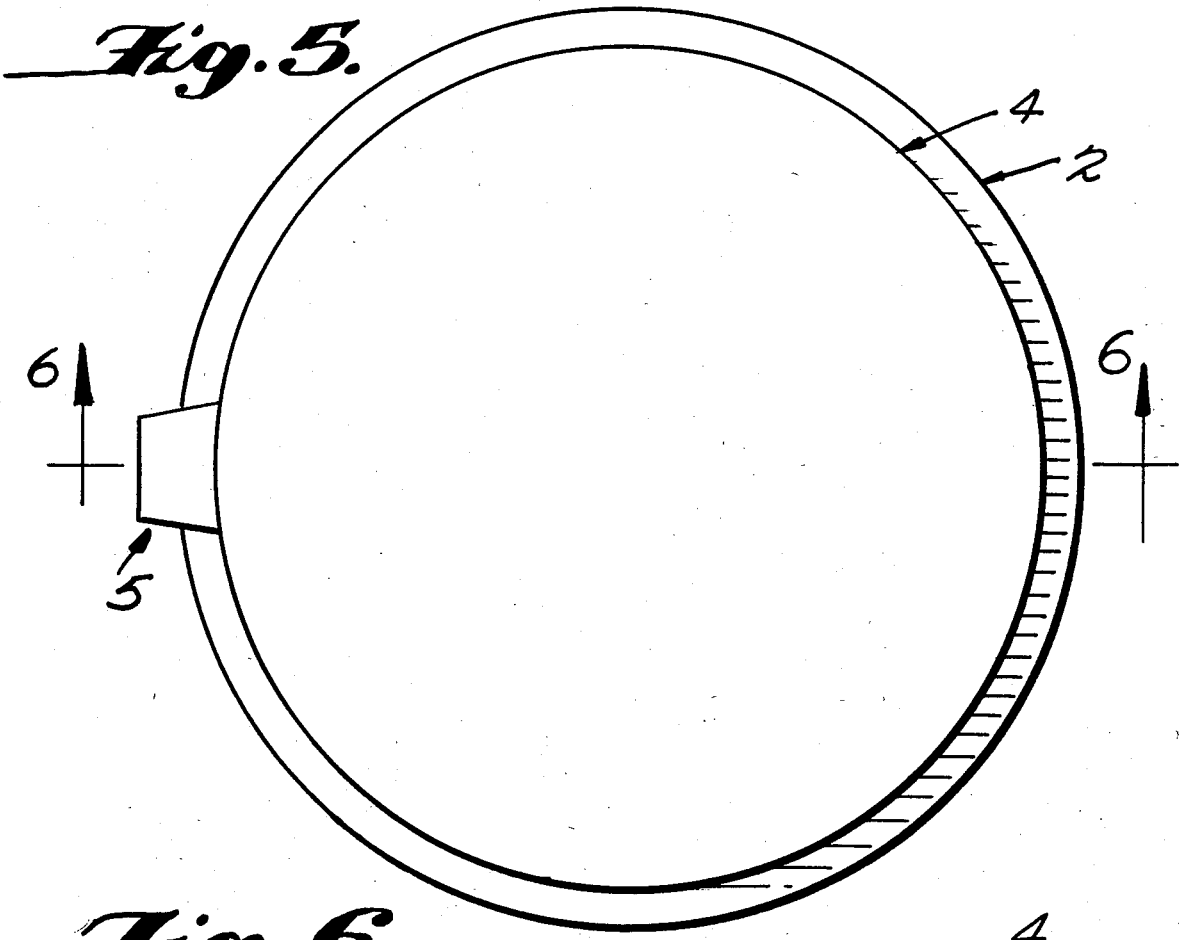
FIG. 5 is a plan view of the cap and neck of FIG. 1.
Figure 6:
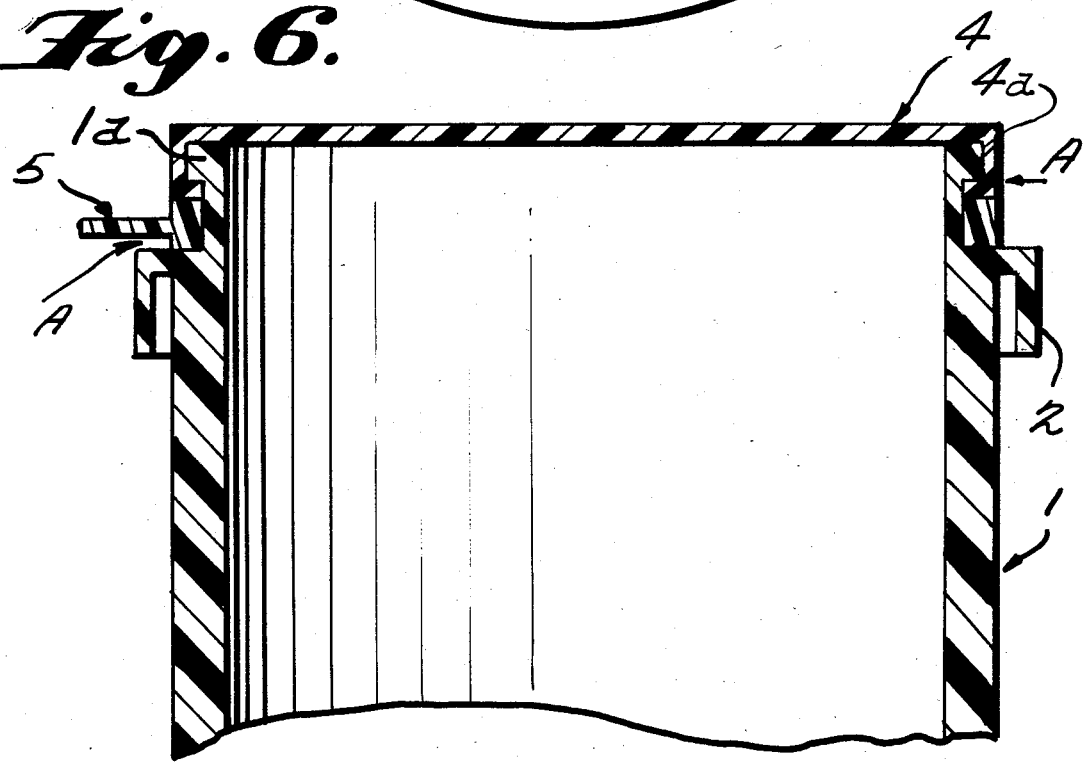
FIG. 6 is a sectional view taken on the line 6—6 of FIG. 5.

FIG. 4 shows in side view the effect of further rotation of the ejector element A from the position shown in FIG. 3.

It will be apparent that while this particular example illustrates a simple and preferred embodiment of our invention, it may be carried into effect in numerous other related ways. For example, while the lug 5 does facilitate rotation of the ejector element A, it is not essential to the working of the invention. If the element A is large enough, for example, it may well be possible to turn it without any extra assistance. Optionally rotation can be aided by adding serrations, depression or other known means of improving purchase, to the element A.

The ejector element A need not be a complete circle. The main requirement is that the ejector element A shall retain sufficient grip on the neck to remain in position when it is not in use.

Similarly, the flange 2 need not necessarily be of greater diameter than the neck 1. It will be apparent that the same purpose would be served by a reduction in diameter of the portion of the neck adjacent its open end, the shoulder so-formed then corresponding to the wall of the flange bearing the contoured section 3.

In a further embodiment of the invention, the ejector element A may have the shape of a ring, the width of which is so-varied that in side elevation the ring resembles a wedge. This must, of course, be complemented by a matching gap between cap and flange as described hereinabove.

The cylindrical neck may be, for example, the neck of a bottle or like container or an extension neck fitted to a container of much larger dimensions than the neck. It could also be the end of a pipeline which must be temporarily blanked off for some purpose.

We claim:

1. In combination with a cylindrical neck having an open end, a replaceable flexible cap friction fitted to said neck, said cap having a circumferential edge for removing the cap by applying axial force to said edge, a discrete flexible ejector element circumferentially slidable relative to said neck in a track defined by and between the edge of the cap and a circumferentially extending shoulder in said neck and cooperating with said edge and said shoulder, the circumferentially extending shoulder being essentially planar and provided with a concave section, the ejector element being essentially ring-shaped and having a lobe receivable by said concave section, the circumferentially extending shoulder and the ejector element being arranged such that the cap is fully received on the neck when the lobe is received in the concave section, and further arranged such that rotation of the ejector causes a camming action between the ejector element and the shoulder thereby urging the lobe and the section of the cap adjacent the lobe axially away from the neck.

* * * * *